US012704028B2

(12) United States Patent
Hoffos

(10) Patent No.: US 12,704,028 B2
(45) Date of Patent: Aug. 11, 2026

(54) SPRING BAIL CYLINDER APPARATUS

(71) Applicant: Kelsey Leroy Hoffos, Laglace (CA)

(72) Inventor: Kelsey Leroy Hoffos, Laglace (CA)

( * ) Notice: Subject to any disclaimer, the term of this patent is extended or adjusted under 35 U.S.C. 154(b) by 0 days.

(21) Appl. No.: 18/945,766

(22) Filed: Nov. 13, 2024

(65) Prior Publication Data

US 2025/0154834 A1 May 15, 2025

Related U.S. Application Data

(60) Provisional application No. 63/598,216, filed on Nov. 13, 2023.

(51) Int. Cl.
*E21B 19/06* (2006.01)
*E21B 19/089* (2006.01)

(52) U.S. Cl.
CPC ..... *E21B 19/06* (2013.01); *E21B 19/089* (2013.01)

(58) Field of Classification Search
CPC ..... E21B 19/06; E21B 19/089
See application file for complete search history.

(56) References Cited

U.S. PATENT DOCUMENTS 2,100,779 A * 11/1937 Hertel ..... F16B 45/026 294/82.21
2,757,740 A * 8/1956 Bohannan ..... E21B 47/117 166/75.13
3,351,372 A * 11/1967 Marks ..... E21B 19/04 294/90
3,857,450 A * 12/1974 Guier ..... E21B 19/06 175/207
7,353,880 B2 * 4/2008 Pietras ..... E21B 3/022 166/77.51
2001/0011589 A1 * 8/2001 Mullins ..... E21B 34/063 175/218
2005/0000696 A1 1/2005 McDaniel et al.
(Continued)

FOREIGN PATENT DOCUMENTS

CN 204783929 U 11/2015
WO 2013159202 A1 10/2013

OTHER PUBLICATIONS

International Search Report and Written Opinion of the International Searching Authority, International Application No. PCT/CA2024/051501, date of mailing: Jan. 10, 2025 (Oct. 1, 2025).

*Primary Examiner* — Shane Bomar
(74) *Attorney, Agent, or Firm* — Amburn Law PLLC; Dean W. Amburn

(57) ABSTRACT

In some implementations, the process may include securing, via an elevator, the tubular where the elevator is connected to a lifting mechanism by two or more spring bail cylinders in a retracted configuration. In addition, the process may include lifting the tubular via the elevator and converting the two or more spring bail cylinders to an extended configuration by the weight of the tubular. The process may include aligning the tubular with a member of the CRT at a top of the tubular, aligning the two or more spring bail cylinders around the CRT, and lowering the tubular to shift the weight of the tubular to a bottom of the tubular. Moreover, the process may include lowering the CRT and the two or more spring bail cylinders while simultaneously converting to the retracted configuration while maintaining alignment of the member of the CRT with the top of the tubular.

18 Claims, 35 Drawing Sheets

(56) References Cited

U.S. PATENT DOCUMENTS

| | | | | |
|---|---|---|---|---|
| 2006/0108124 | A1 | 5/2006 | Barker et al. | |
| 2006/0249292 | A1 | 11/2006 | Guidry | |
| 2007/0193751 | A1 | 8/2007 | Pietras et al. | |
| 2012/0247786 | A1* | 10/2012 | Pietras | E21B 19/06 166/380 |
| 2014/0090856 | A1* | 4/2014 | Pratt | E21B 19/06 166/380 |
| 2014/0110135 | A1* | 4/2014 | Meaux | E21B 19/08 166/382 |
| 2025/0207468 | A1* | 6/2025 | Slack | E21B 19/06 |

* cited by examiner

SPRING BAIL CYLINDER APPARATUS

TECHNICAL FIELD

The invention generally relates to oil and gas well drilling equipment and, more particularly, to tools used to assist in a stab-in procedure while using a casing running tool (CRT) on an oil and gas drilling rig.

BACKGROUND

In well drilling, specifically including oil and gas well drilling, conventional casing (aka., tubulars) operations typically involve specialized crews and equipment that are brought to a rig site for the sole purpose of running the casing. The casing crews rig up tools and operate the equipment, connecting each joint of the casing to be lowered into the well bore. The driller who operates the top drive will use a stab-in procedure of the CRTs (e.g., VOLANT, DRAWWORKS, and others). In this process a rigid bail is set in length, or a VARILINK bail can be manually adjusted by the rig crew. The use of stabbing guides into each joint of the box end on the casing is done to help entry, but use of sensors on the drilling platform halts operation when people set foot on the rig's floor. As a result, manual use of guides is unavailable, and the use of alternatives may make this process more efficient. The hydraulic supply system at this area of the drilling rig is also completely saturated, so hydraulic bails could not be used without an extra service loop added. Lastly, the bails must operate in −40° C. weather, as such, electronic bails cannot be used. Therefore, there is an opportunity for improvement to the bail and as a result improve safety and efficiency on an oil and gas well drilling rig.

SUMMARY

The following disclosure of embodiments of a spring bail cylinder, which is designed for the gas and oilfield industry and is for use on all drilling rigs to assist in the stab-in procedure of the CRT. It is an object of the invention that the spring bail cylinder steadies or aligns the tubular so the CRT connected to a top drive system can be easily stabbed in and the drilling crew can run entire strings of casing more efficiently and for less cost than with conventional casing crews and equipment. In nonlimiting embodiments of the spring bail cylinder, the apparatus includes a cylinder, spring, and plunger. In some embodiments, the spring bail cylinder is used to align the casing or tubular into the CRT or top drive. It has been experienced that once the tubular elevators stopped being in contact with an upward force, the tubular would fall out of alignment. The spring bail is used to keep the upward force as the top drive, or CRT is lowered into or onto the tubular. This tool fits onto the bail extension such as the VARILINK bail extension, and could be fit to any style of bail used in the drilling operations.

The invention design functions as workers latch an elevator onto the tubular at the floor level or next to the string. As the tubular or casing is hoisted the weight of the tubular or casing compress the spring until the max extension is reached by the inside stopper. Once this occurs, the weight is transferred to the body of the spring bail cylinder, stopping the compression on the spring. In some embodiments, when used in a pair, the rated hoist capacity may be 25 tons or 12.5 tons per side. Once the tubular or casing is of an appropriate height it then can be maneuvered to center of well bore and lowered on top of the exposed stump of drill or casing string.

As the tubular or casing is lowered and stabbed into the stump, the weight will transfer from the spring bail cylinder and stopper back onto the spring. As the elevators travel downward off the tubular or casing coupling, the spring holds it in upward force to keep the elevator in contact with the coupling, thus keeping the tubular or casing aligned with the top drive or CRT. Thus, the invention stops potential misalignment and improves rig time.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION

Figure 1A:
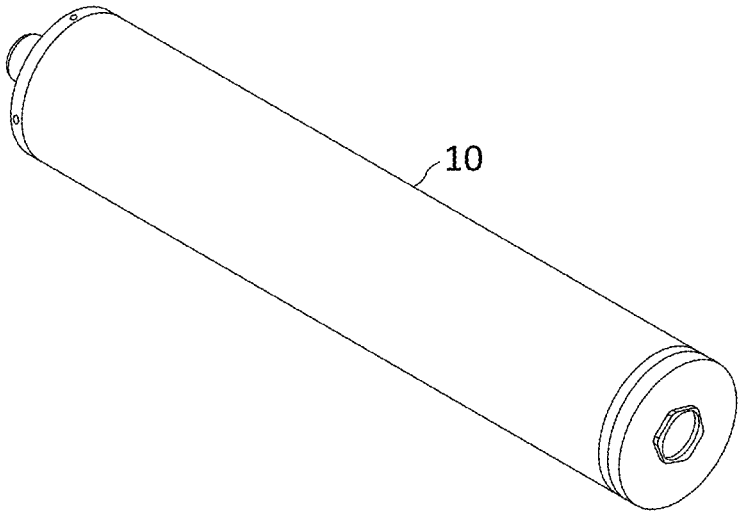
FIG. 1A is a perspective view of a nonlimiting embodiment of a spring bail cylinder apparatus of the invention.
Figure 1B:
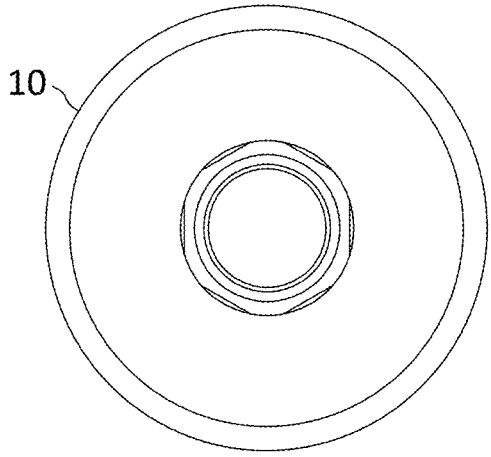
FIG. 1B is a first end plan view of the apparatus of FIG. 1.
Figure 1C:
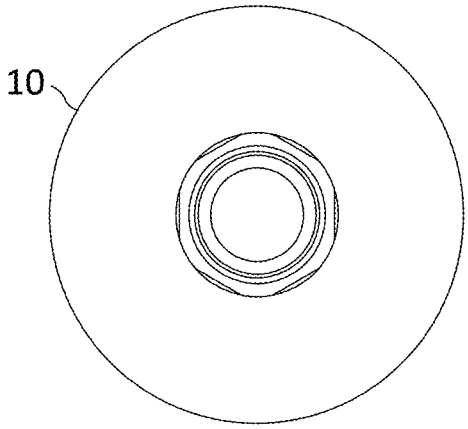
FIG. 1C is a second end plan view of the apparatus of FIG. 1.
Figure 1D:
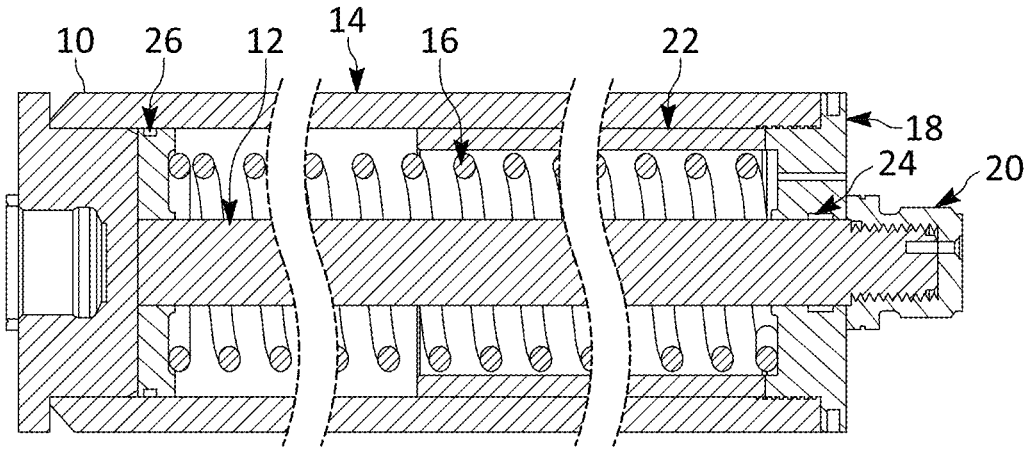
FIG. 1D is a cross sectional view of the apparatus of FIG. 1 along the lines 1D-1D as seen in FIG. 1C.
Figure 2A:
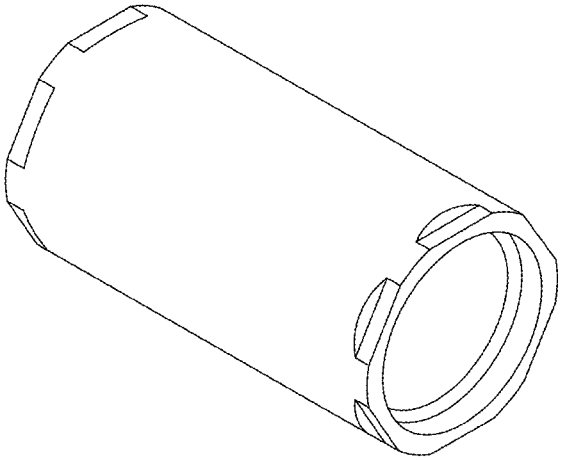
FIGS. 2A-2C are prospective, plan, and cross-sectional views of an adapter of the apparatus of FIG. 1.
Figure 2B:
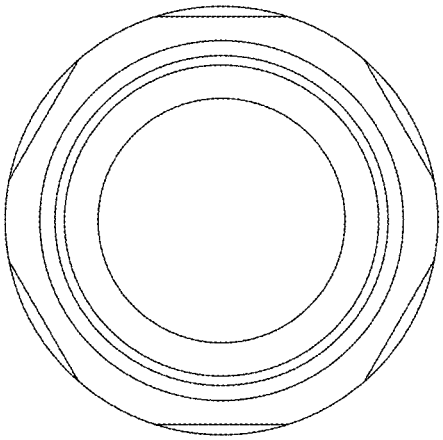
Figure 2C:
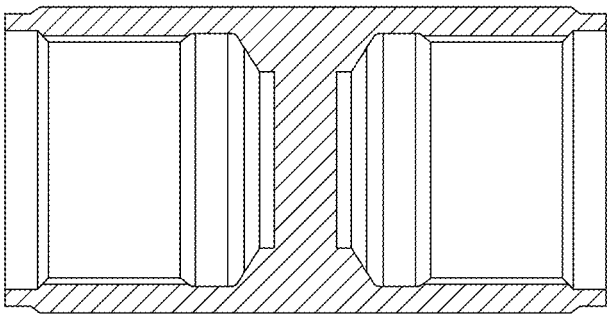
Figure 3A:
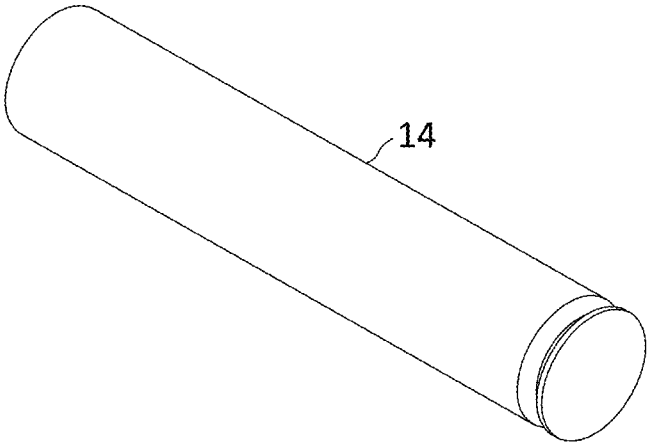
FIGS. 3A-3C are prospective, plan and cross-sectional views of a cylinder of the apparatus of FIG. 1.
Figure 3B:
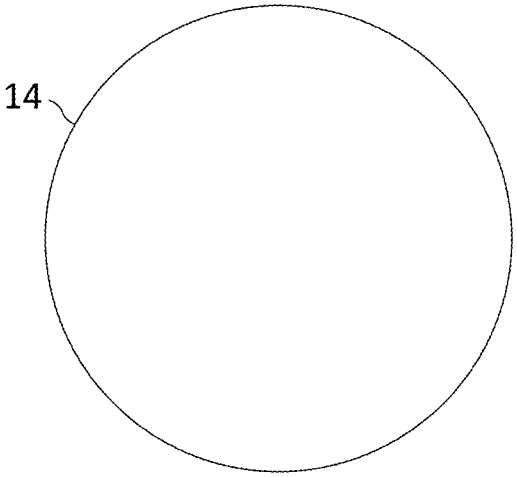
Figure 3C:
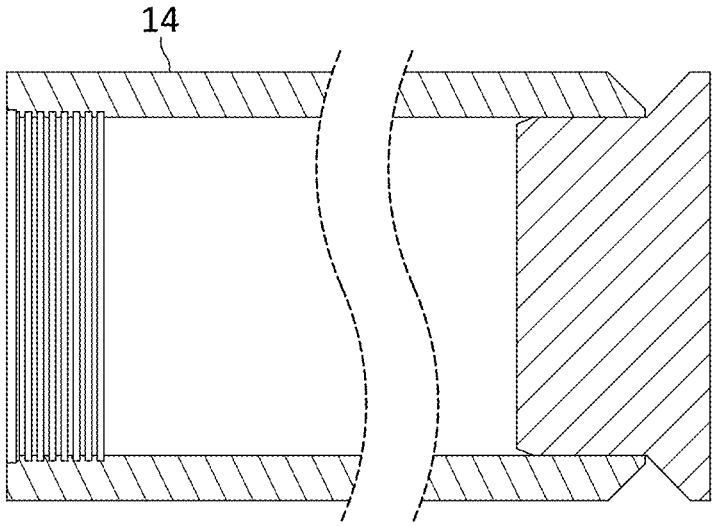
Figure 4A:
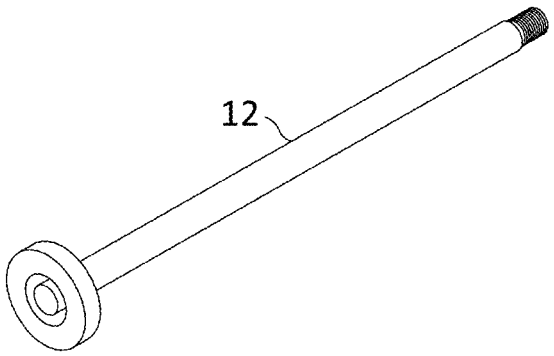
FIGS. 4A-4C are prospective, plan and cross-sectional views of a plunger of the apparatus of FIG. 1.
Figure 4B:
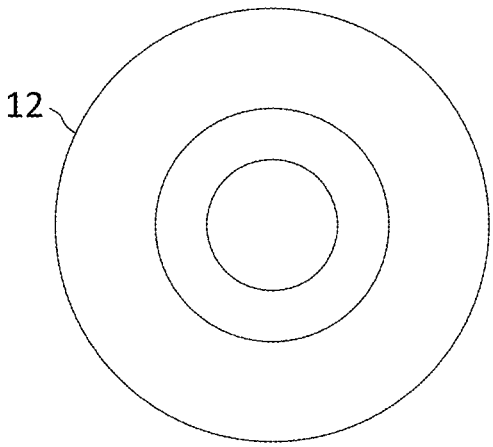
Figure 4C:
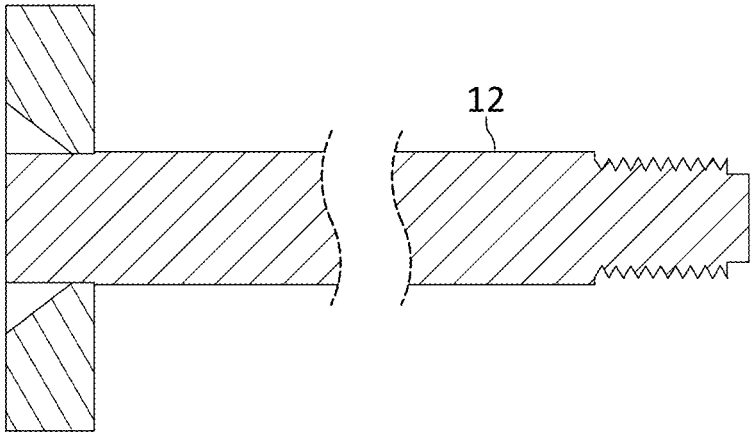
Figure 5A:
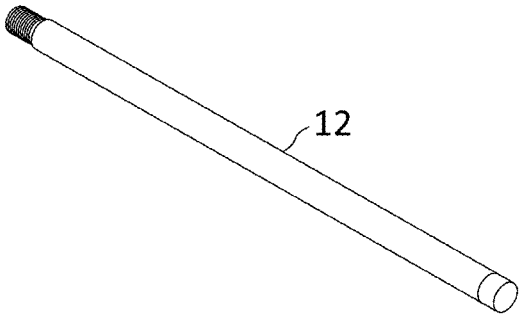
FIGS. 5A-5C are prospective, plan and cross-sectional views of a plunger rod of the apparatus of FIG. 1.
Figure 5B:
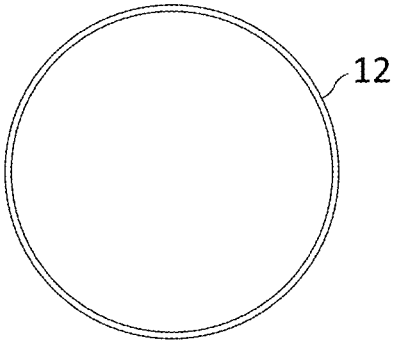
Figure 5C:
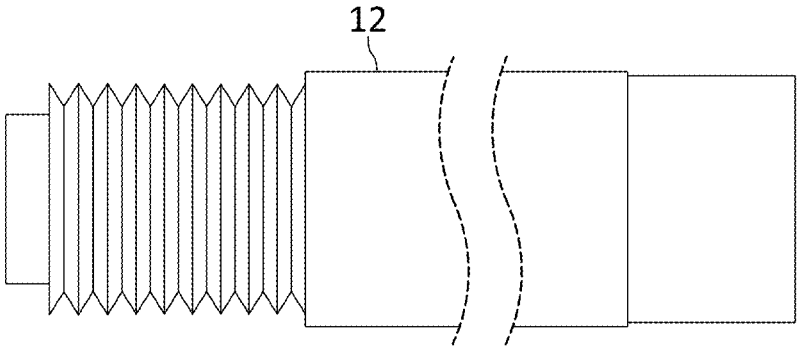
Figure 6A:
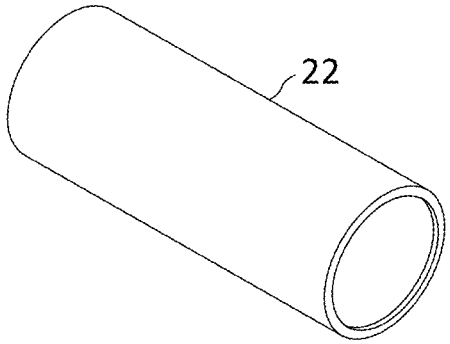
FIGS. 6A-6C are prospective, plan and cross-sectional views of a stopper of the apparatus of FIG. 1.
Figure 6B:
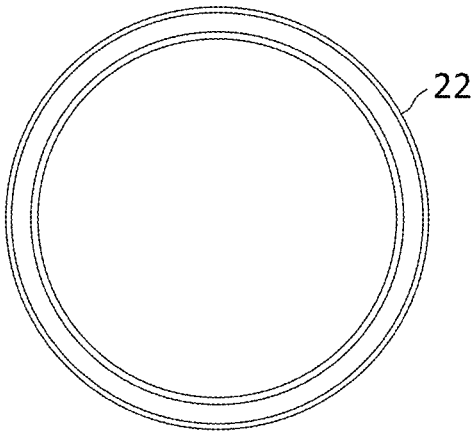
Figure 6C:
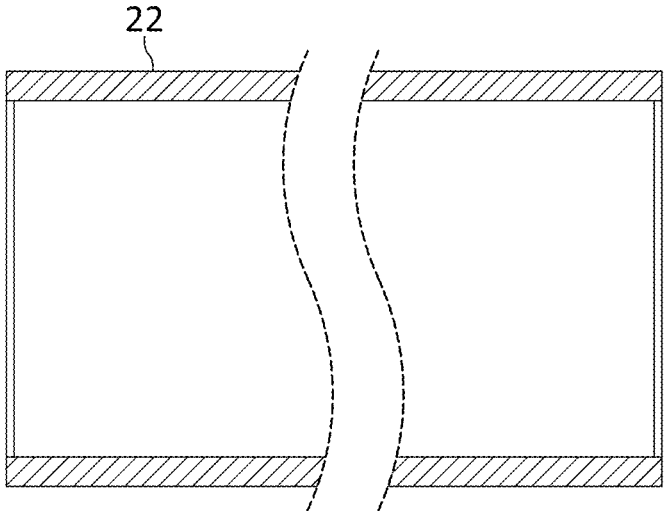
Figure 7A:
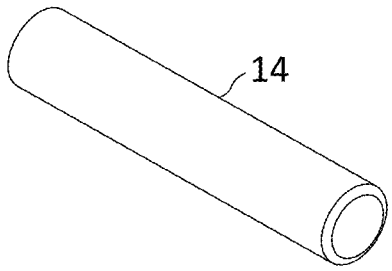
FIGS. 7A-7C are prospective, plan and cross-sectional views of a cylinder tube of the apparatus of FIG. 1.
Figure 7B:
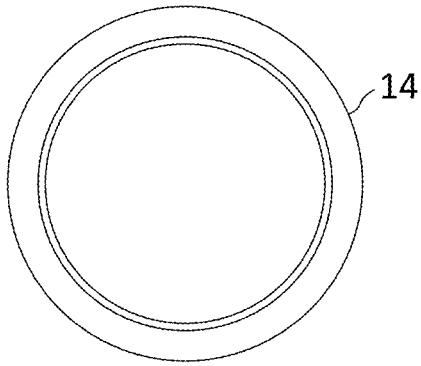
Figure 7C:
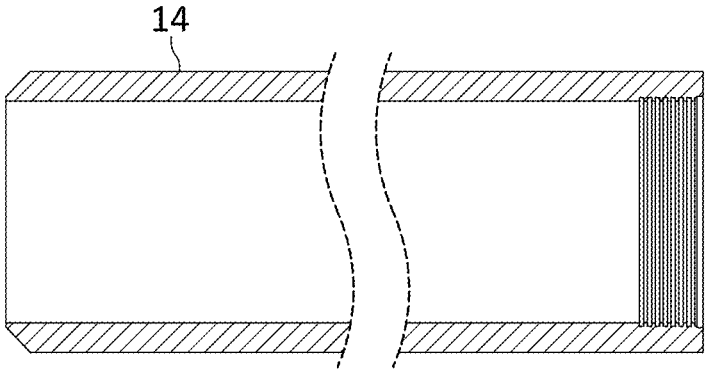
Figure 8A:
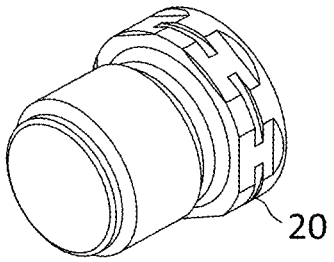
FIGS. 8A-8D are prospective, plan and cross-sectional views of a spring rod adapter of the apparatus of FIG. 1.
Figure 8B:
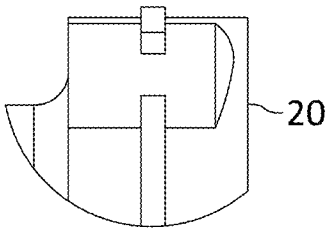
Figure 8C:
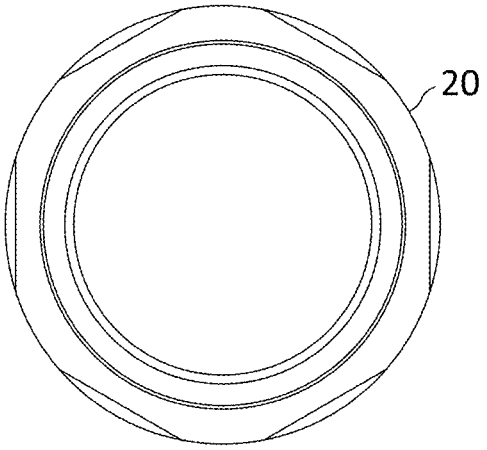
Figure 8D:
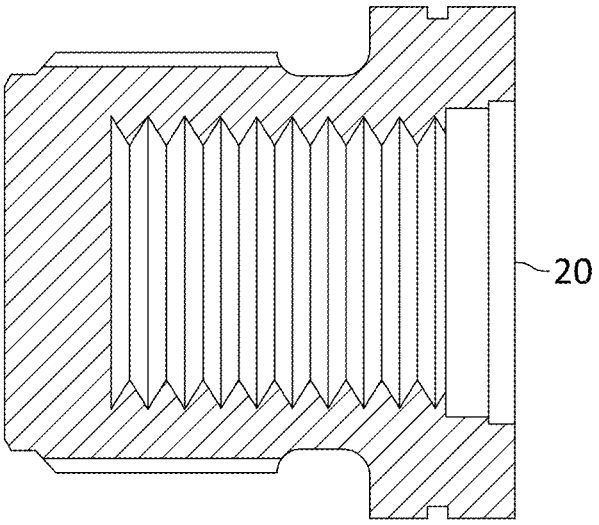
Figure 9A:
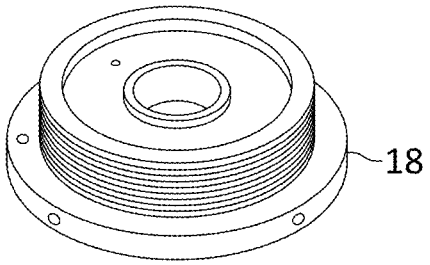
FIGS. 9A-9C are prospective, plan and cross-sectional views of a gland of the apparatus of FIG. 1.
Figure 9B:
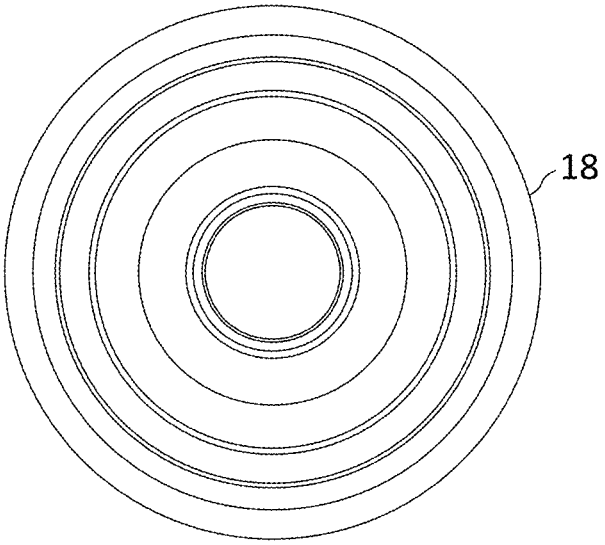
Figure 9C:
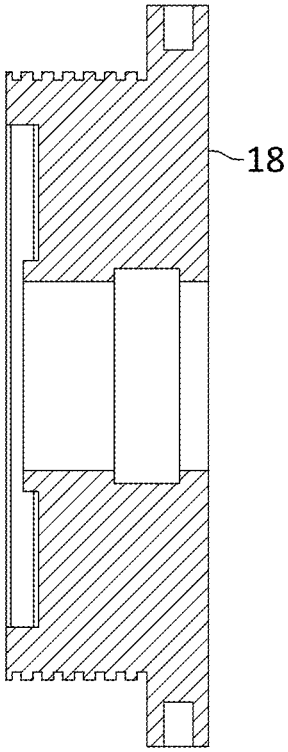
Figure 10A:
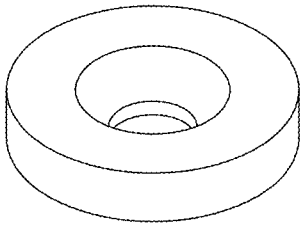
FIGS. 10A-10C are prospective, plan and cross-sectional views of a plunger piston of the apparatus of FIG. 1.
Figure 10B:
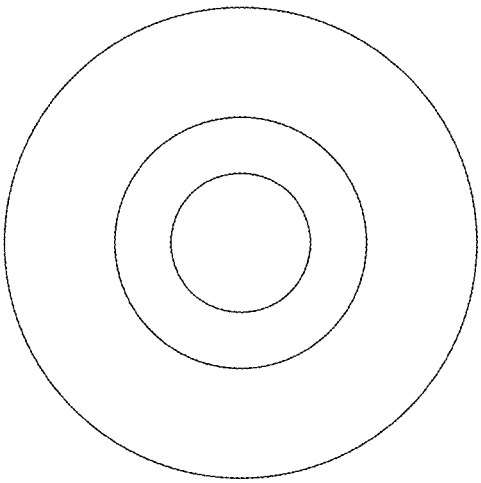
Figure 10C:
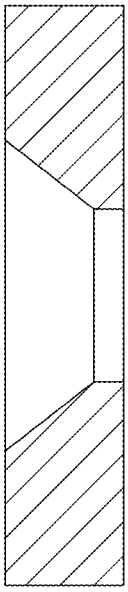
Figure 11A:
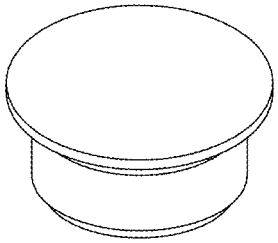
FIGS. 11A-11C are prospective, plan and cross-sectional views of a plug of the apparatus of FIG. 1.
Figure 11B:
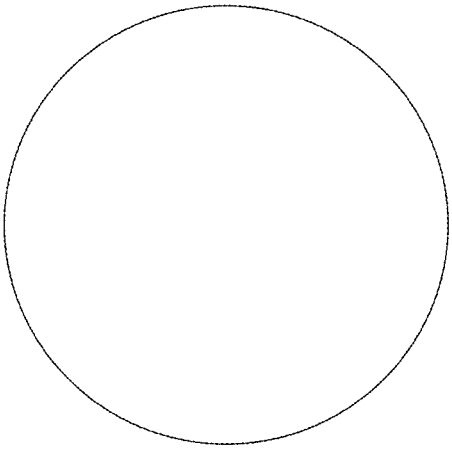
Figure 11C:
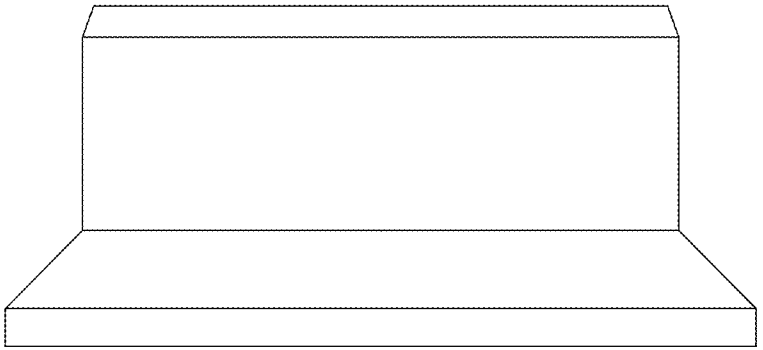
Figure 12A:
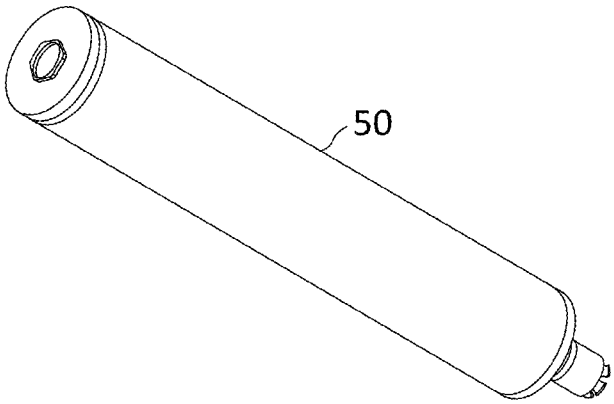
FIGS. 12A-12D are a perspective, end, cross-sectional and exploded views of a second nonlimiting embodiment of a spring bail cylinder apparatus of the invention.
Figure 12B:
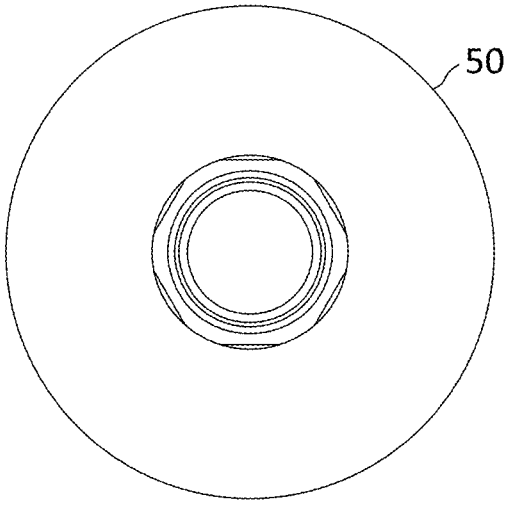
Figure 12C:
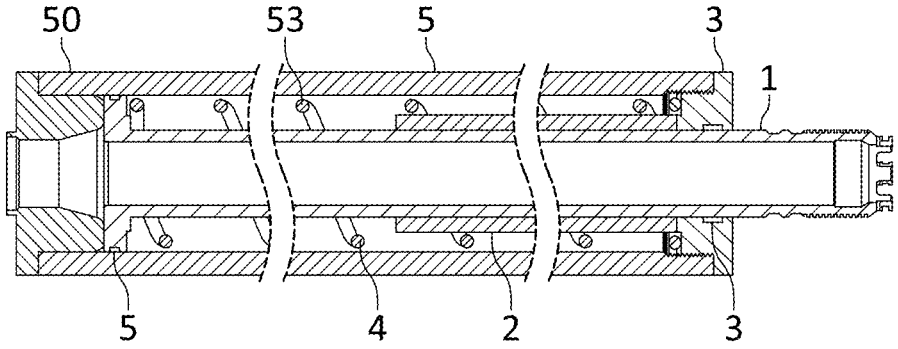
Figure 12D:
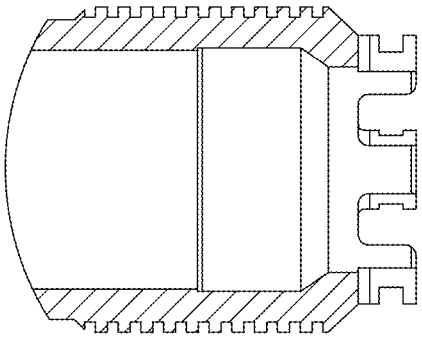

Referring to FIGS. 1-11, in a nonlimiting embodiment, the spring bail cylinder apparatus 10, (hereinafter referred to as the spring bail cylinder 10 or apparatus) of the invention includes three sections, including a plunger 12, a cylinder 14, and a spring 16. In some embodiments, the cylinder 14 comprises a stopper cylinder 22, and a gland 18. The cylinder 14 is plugged on one end, with a stub acme thread in the center, and open on the other, with a thread about its internal diameter. The cylinder plug features an internal recess for the spring to rest in, thus keeping the spring centered during operation.

In some embodiments, the stopper cylinder 22 is slightly smaller on its outer diameter than the internal diameter of the main cylinder 14, which limits the spring's 16 movement, and facilitates the transfer of the load from the plunger 12 directly to the cylinder 14, bypassing the spring 16.

In some embodiments, the gland 18, similar to a hydraulic cylinder, is a removable threaded plug for the cylinder 14, with a small hole through its center allowing the small outer diameter of a rod of the plunger 12 to slide through during its movement. The gland 18 is threaded onto the cylinder 14, sealing it, a socket headed screw locks the gland to the cylinder, preventing it from unscrewing during operation. The gland 18 is threaded onto the cylinder 14 for ease of assembly and maintenance.

In some embodiments, the spring 16 is a compression spring, in a top hanger style, under preload within both the main cylinder and the stopper cylinder. In some embodiments, a top hanger spring may be used to support tubulars that experience vertical movement. These springs may compress or extend, allowing adjustment to the tubular's movement. The unique feature of a variable spring hanger is that it may be supporting force changes as the spring is compressed or extended. In some embodiments, when the tubular moves up or down, the spring adjusts its position, and the amount of force it exerts on the tubular changes accordingly.

In some embodiments, when the tubular expands and moves upward, the spring compresses, which may increase the force applied to support the tubular. Conversely, when the tubular contracts and moves downward, the spring may extend, reducing the supporting force. This variability in force is why they are called "variable" spring hangers.

In some embodiments, the plunger 12 is made of two parts, a rod, and an adapter 20. The rod is a small diameter rod, with a wide disc located on one end, and a short-threaded section on the other. The wide disc features small holes to let the separate cylinder sections equalize in pressure, and a recess for the spring to rest in, keeping it centered during operation.

In some embodiments, the adapter 20 is attached to the short-threaded section of the rod, with the gland 18 between the adapter 20 and the spring 16. The adapter 20 acts as both a lock and safety on the preloaded spring and gland 18, and changes the outer diameter of the rod, such that it can mate with larger diameter bail attachment ends. A socket head screw is offset from the center of the adapter, into the rod, preventing it from unscrewing during operation.

In operation, the spring bail cylinder 10 may include four steps to its movement: (1) the spring bail cylinder 10 is at a certain shorter length when the load does not exceed the pre-load on the spring; (2) the spring bail cylinder 10 will extend to its maximum length when the spring's preload is exceeded; (3) the spring bail cylinder 10 will transfer the load from Plunger→Spring→Cylinder, to Plunger→Stopper→Cylinder when the limit of its travel is reached; and (4) the spring bail cylinder 10 will retract to its shortest length when the load is reduced to less than the spring's preload. In some embodiments, the pre-load of the spring may be a threshold for converting the spring bail cylinder 10 from a retracted configuration to an extended configuration. In some embodiments, the threshold load for converting the spring bail cylinder 10 from a retracted configuration to an extended configuration may be determined based on the weight of the tubular the spring bail cylinder 10 is configured to work with. For example, the threshold load to convert the spring bail cylinder 10 from a retracted configuration to an extended configuration may be slightly less than the weight of the tubular so the spring bail cylinder 10 may convert when the weight of the tubular is exerted upon it.

Now referring to FIGS. 12A-12D, in a second nonlimiting embodiment of the invention, the spring bail cylinder 50 includes a tube 52, a spring 53, a rod 54, a cylinder 14, a gland 56, and a cap 58. The second nonlimiting embodiment of the spring bail cylinder 50 works the same as the first embodiment. The second embodiment is slightly larger (due to the adjustable rod and its dimensions as it adapts to the bottom section of the a bail, such as the VARILINK bail. This can be operated in a shorter length.

In some embodiments, the spring bail cylinder 50 be comprised of 4130 tool steel, apart from the outer cylinder, which may be comprised of 1029 steel. The 4130 tool steel was chosen for its excellent tensile strength at smaller diameters, a necessity due to the large potential loads, and diameter limitations of its use application. The outer cylinder may be comprised of 1026 steel, as 4130 steel for that diameter and length would have been too costly to machine on a short timeline. In some embodiments, components made from aluminum, carbon, titanium, plastic, or some composite thereof.

In some embodiments, the spring bail cylinder 50 was designed as an improvement over a hydraulic cylinder due to its excellent wear resistance at high cycle rates. To assist in wear resistance, nylon wear bands, sourced from hydraulic cylinders, may be used where metal would otherwise slide against metal, greatly reducing friction and wear. The wear bands are located along the outside of the rod's wide end to reduce friction on the cylinder and about the inside of the small hole in the gland to reduce wear on the rod as it moves through.

In some embodiments, the internal walls of the cylinder will also be lubricated to reduce friction and prevent corrosion from ambient moisture. As the cylinder is not a hydraulic cylinder, small holes have been drilled through the wide disc of the plunger and the threaded gland to allow the pressure in the two halves to equalize. This has the added benefit of providing a slight cushion to the cylinder as it extends and retracts. The pressures equalize slowly, creating a negative pressure that resists the movement of the cylinder until they equalize. Further development may include the use of pressurized air in this chamber.

In some embodiments, the outermost hole may be drilled into the gland as it faces downward, which may prevent rain and snow from seeping into the cylinder and may also act as a drain in case condensation begins to build up inside.

In some embodiments, the spring bail cylinder 50 may be configured for use on a drilling rig floor, and the hydraulics are saturated in sub-zero climates to allow the extension and alignment of the rig's elevator with its top drive and subsequent retraction once the tubular is stabbed into the stump and top drive is lowered to connect with box end of the new joint.

In some embodiments, the spring bail cylinder 50 may be operated without outside intervention and is resistant to high cycle rates, corrosion, and cold while operating.

Figure 13:
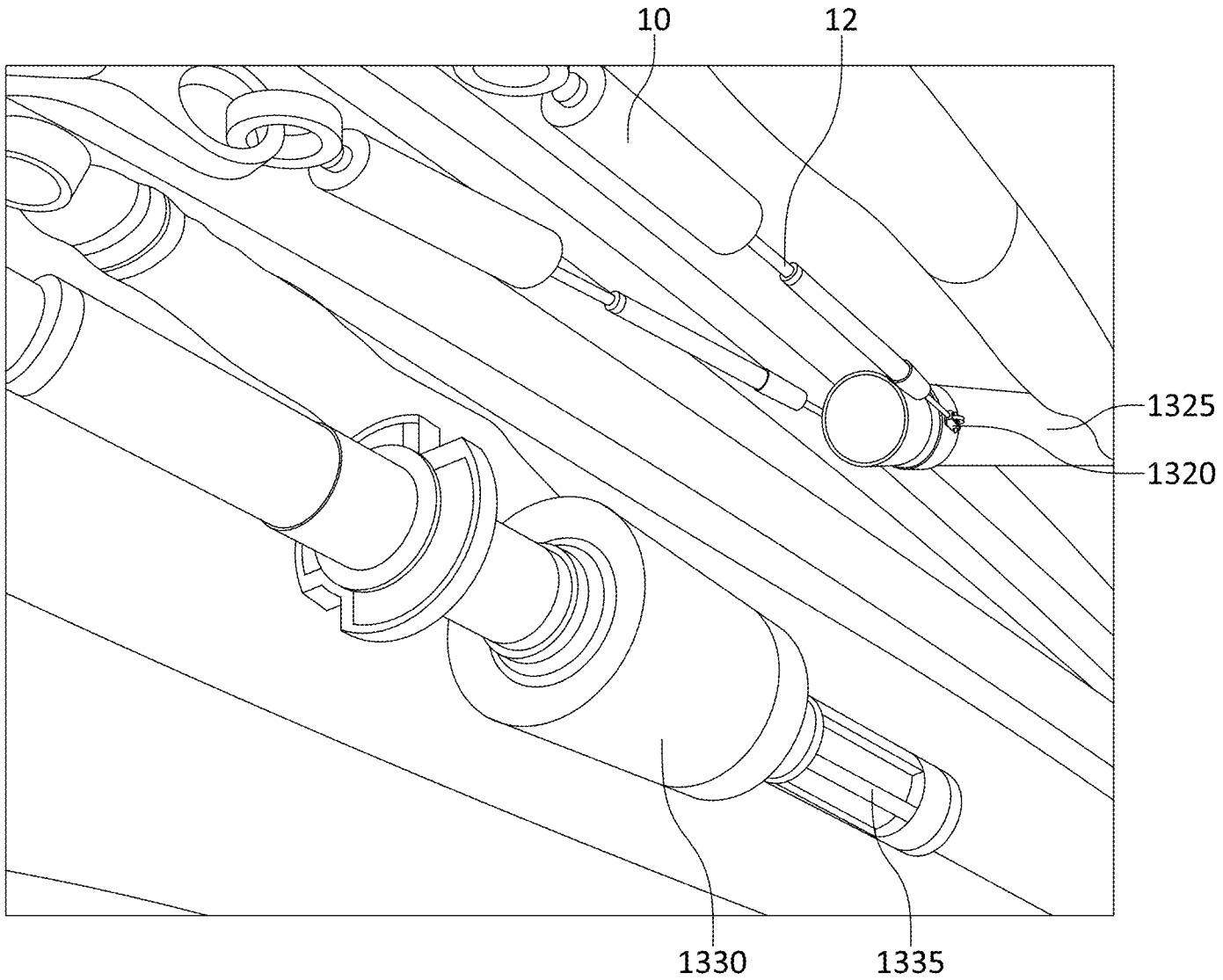
FIG. 13 illustrates a view of a non-limiting example embodiment of the spring bail cylinder apparatus in an extended configuration while lifting a tubular into a rig, according to the systems and methods described herein.

FIG. 13 illustrates a view of a non-limiting example embodiment of the spring bail cylinder 10 in an extended configuration while lifting a tubular 1325. In some embodiments, the elevator 1320 holds the weight of the tubular 1325 from a coupling at the top of the tubular 1325. In some embodiments, the weight of the tubular 1325 is transferred to the spring bail cylinder 10 converting the spring bail cylinder 10 to an extended configuration, and exposes the plunger 12 of the spring bail cylinder 10. In some embodiments, the elevator 1320 lifts the tubular 1325 toward a vertical position directly below a member 1335 of the CRT 1330. In some embodiment, the movements of the elevator 1320 may be controlled by a top drive of the rig.

In some embodiments, a tubular may comprise multiple tubulars already connected via couplings or any other tubular connection approach.

Figure 14:
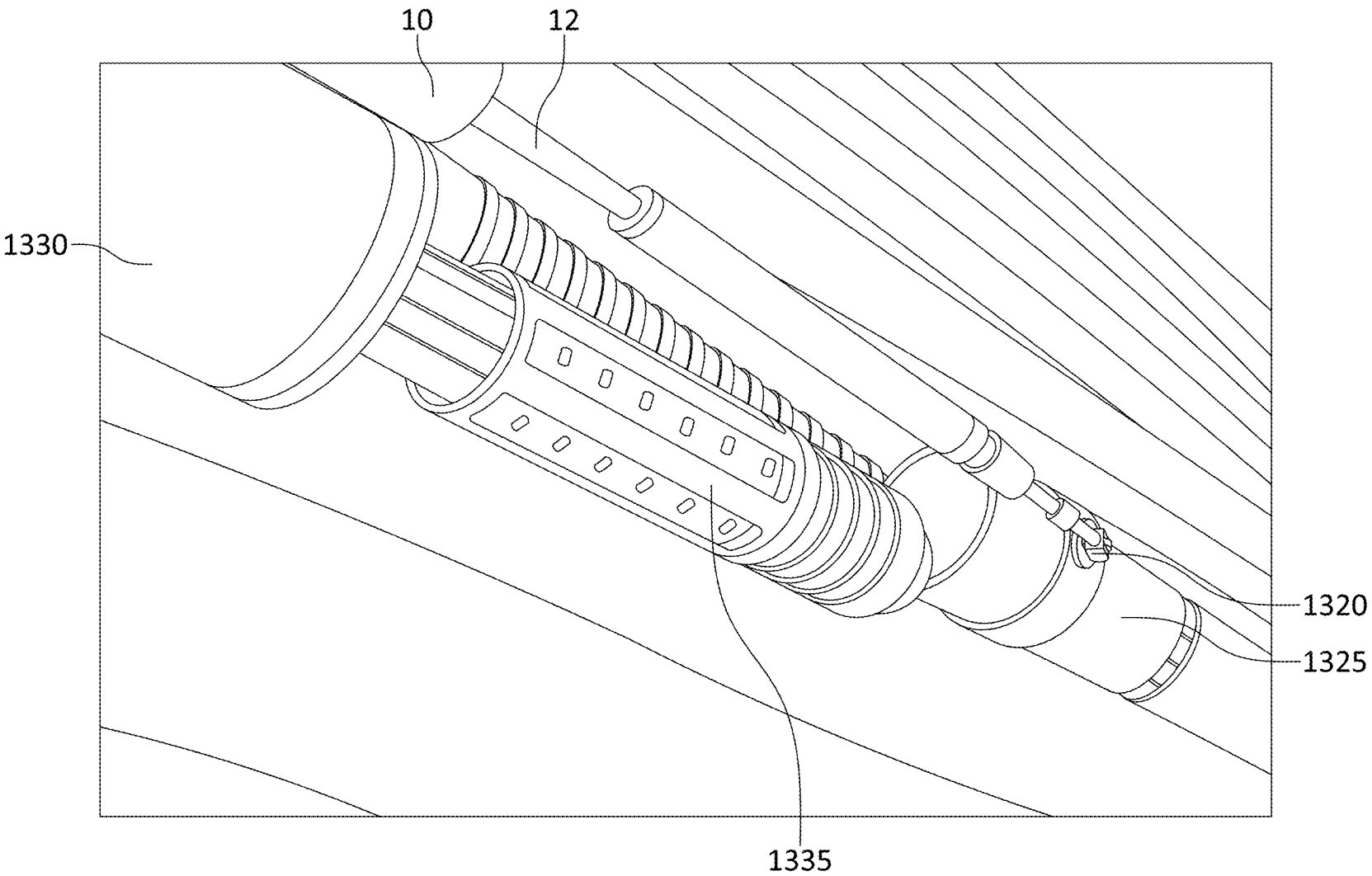
FIG. 14 illustrates a view of a non-limiting example embodiment of the spring bail cylinder apparatus in an extended configuration, aligning a tubular with a member of a CRT, according to the systems and methods described herein.

FIG. 14 illustrates a view of a non-limiting example embodiment of the spring bail cylinder 10 in an extended configuration being aligned about a CRT 1330. In some embodiments, the elevator 1320 positions the tubular 1325 vertically below a member 1335 of the CRT 1330. In some embodiments, two or more spring bail cylinder 10 are connected to the elevator 1320 and may be configured to surround the CRT 1330 to align the tubular 1325 directly below the member 1335 of the CRT 1330 while maintaining a vertical position for the tubular 1325. In some embodiments, the weight of the tubular 1325 may be held by the elevator 1320 and transferred to the spring bail cylinder 10, causing it to maintain an extended configuration.

Figure 15:
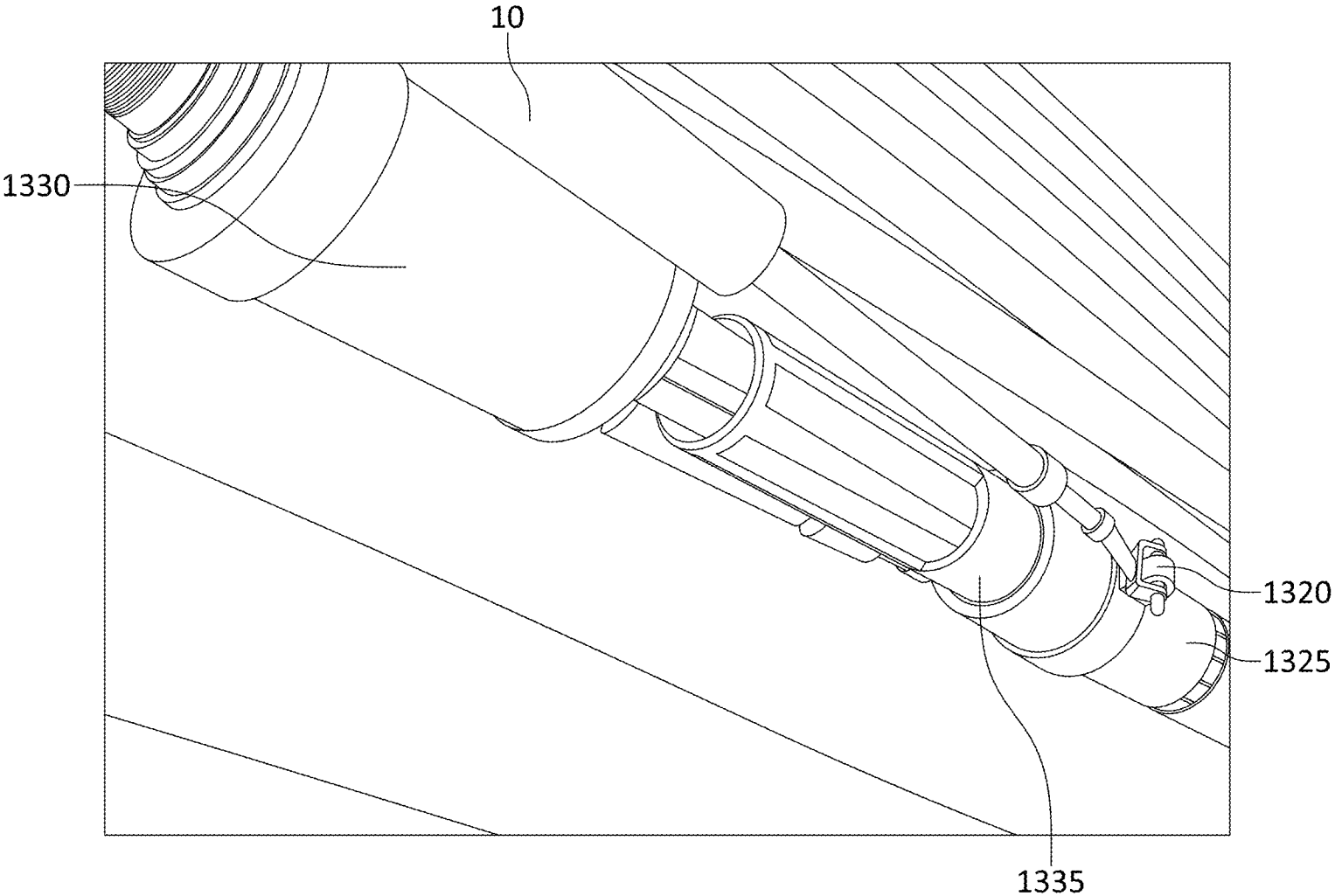
FIG. 15 illustrates a view of a non-limiting example embodiment of the spring bail cylinder apparatus in a retracted configuration, with the member of a CRT being lowered into the tubular, according to the systems and methods described herein.

FIG. 15 illustrates a view of a non-limiting example embodiment of the spring bail cylinder 10 in a retracted configuration with at least some of the weight of the tubular 1325 being held by the floor of the rig. In some embodiments, at least some of the weight of the tubular 1325 may be transferred to a tubular already installed in the well bore. In some embodiments, the transfer of the weight from the elevator 1320 transfers the weight away from the spring bail cylinder 10 while maintaining tension and alignment between the member 1335 of the CRT 1330 and the coupling of the tubular 1325. In some embodiments, the CRT 1330 is lowered and may allow the member 1335 of the CRT 1330 to enter the tubular 1325 while simultaneously shifting the remaining weight held by the elevator 1320 to the rig floor or a tubular already installed in the well bore. In some embodiments, while the remaining weight held by the elevator 1320 is transferred to the rig floor or a tubular already installed in the well bore, the spring bail cylinder 10 converts to a retracted configuration simultaneous with the CRT 1330 being lowered. In some embodiments, the lowering of the CRT 1330 shifts the remaining weight from the elevator 1320 to the well floor, via a tubular already installed in the well bore and simultaneously causes the spring bail cylinder 10 to convert to a retracted configuration. In some embodiments, the contracting of the spring bail cylinder 10 to a retracted configuration utilizes tension from the spring bail cylinder 10 to maintain alignment of the member 1335 of the CRT 1330 with the tubular 1325 as the CRT 1330 lowers the member 1335 into the tubular 1325.

Figure 16:
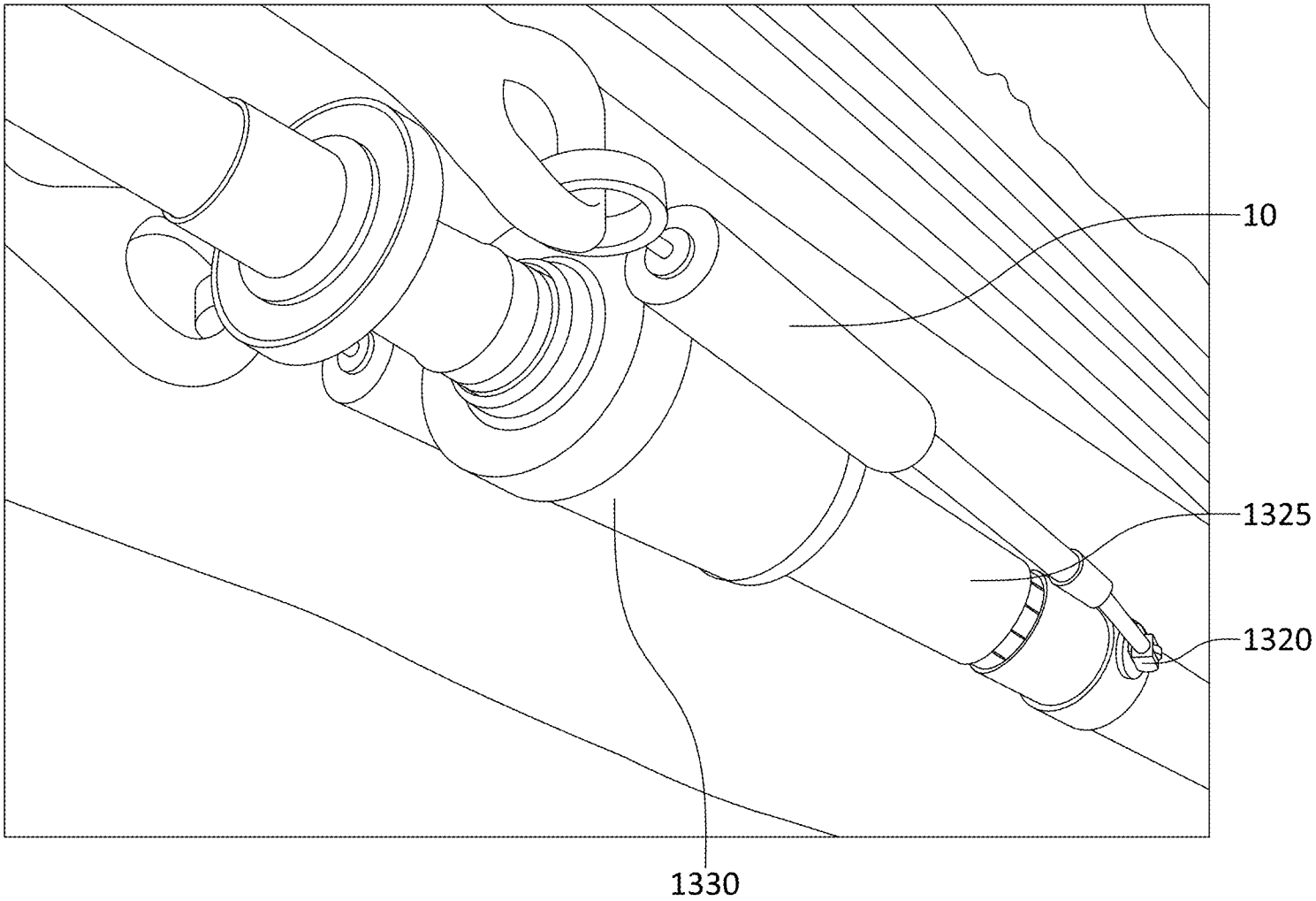
FIG. 16 illustrates a view of a non-limiting example embodiment of the spring bail cylinder apparatus in a retracted configuration, with the CRT fully engaged in the tubular, according to the systems and methods described herein.

FIG. 16 illustrates a view of a non-limiting example embodiment of the spring bail cylinder 10 in a retracted configuration and the member of the CRT 1330 fully installed into the tubular 1325. In some embodiments, the elevator 1320 no longer carries any of the weight of the tubular 1325 from the coupling of the tubular 1325. In some embodiments, the spring bail cylinder 10 may be in a fully retracted position with no weight of the tubular 1325 being transferred from the elevator 1320 to the spring bail cylinder 10. In some embodiments, the member of the CRT 1330 is fully installed into the tubular 1325. In some embodiments, the weight of the tubular 1325 is fully transferred to the floor of the rig or a tubular already installed in the well bore.

Figure 17:
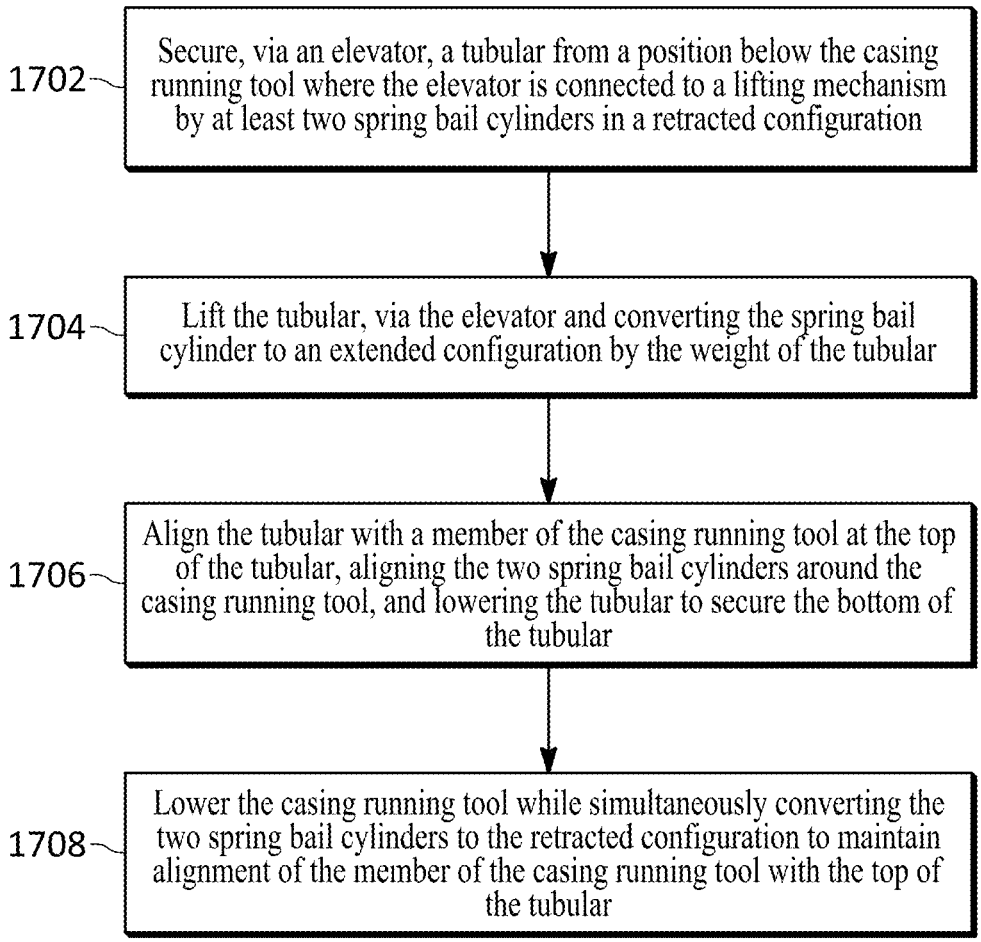
FIG. 17 provides a flowchart describing the process of utilizing a non-limiting example embodiment of the spring bail cylinder apparatus to align and install a CRT with a tubular, according to the systems and methods described herein.

FIG. 17 is a flowchart of an example process 1700. In some implementations, one or more process blocks of FIG. 17 may be performed by a processor or an operator. In some embodiments, the process 1700 may comprise a processor and a memory. The processor may comprise one or more computing cores, which may be configured to execute commands stored in memory. The memory is a non-transitory computer-readable medium which may store computer instructions for execution by the processor.

As shown in FIG. 17, process 1700 may include securing, via an elevator, a tubular 1325 from a position below the CRT 1330 where the elevator 1320 is connected to a lifting mechanism by at least two spring bail cylinders 10 in a retracted configuration (block 1702). For example, a processor may secure, via an elevator 1320, a tubular 1325 from a position below the CRT 1330 where the elevator 1320 is connected to a lifting mechanism by at least two spring bail cylinders 10 in a retracted configuration, as described above.

In some embodiments, the weight of the tubular 1325 rests on a surface below the v-door of the rig and the elevator 1320 secure to the tubular 1325 below a coupling at the top of the tubular 1325, where the coupling has a diameter greater than the body of the tubular 1325. In some embodiments, the elevator 1320 is connected to the lifting mechanism via at least two spring bail cylinders 10 which, since the weight of the tubular 1325 may be on the surface below the v-door, remain in a retracted configuration.

In some embodiments, the lifting mechanism may be used to lift and lower objects that are connected to the lifting mechanism. In some embodiments the lifting mechanism may move objects along three axis such as moving objects along a Y axis while simultaneously moving objects along an X axis. In some embodiments, the lifting mechanism may be the top drive or rig blocks.

As also shown in FIG. 17, process 1700 may include lifting the tubular 1325, via the elevator 1320 and converting the spring bail cylinder 10 to an extended configuration by the weight of the tubular 1325 (block 1704). For example, the processor may instruct the lifting mechanism to lift the tubular 1325, via the elevator 1320 and convert the spring bail cylinders 10 to an extended configuration by the weight of the tubular, as described above.

In some embodiments, when the lifting mechanism lifts the elevator 1320, the elevator 1320 may slide up the body of the tubular 1325 until the elevator 1320 reaches the larger circumference of the coupling installed on the top of the tubular 1325. In some embodiments, the weight of the tubular 1325 may be converted from the bottom surface of the v-door to the point where the elevator 1320 meets the bottom of the coupling installed on the top of the tubular 1325. In some embodiments, the weight may also be transferred to the spring bail cylinders 10 which may sit between the elevator and the lifting mechanism. In some embodiments, the weight of the tubular 1325 may convert the spring bail cylinders from a retracted configuration to an extended configuration as the tubular 1325 is lifted up through the v-door. In some embodiments, the tubular may remain in a slanted position until pulled fully through the v-door after which the tubular 1325 converts to a vertical position in parallel with the midline of the rig. In some embodiments, the tubular 1325 may presented in a vertical configuration when secured by the elevator 1320.

As further shown in FIG. 17, process 1700 may include aligning the tubular 1325 with a member 1335 of the CRT 1330 at the top of the tubular 1325, aligning the two spring bail cylinders 10 around the CRT 1330, and lowering the tubular 1325 to secure the bottom of the tubular 1325 (block 1706). For example, the processor may instruct the lifting mechanism to align the tubular 1325 with a member 1335 of the CRT 1330 at the top of the tubular 1325, aligning the two spring bail cylinders 10 around the CRT 1330, and lowering the tubular 1325 to secure the bottom of the tubular, as described above.

In some embodiments, at least some of the weight of the tubular 1325 may be transferred to a tubular already installed in the well bore. In some embodiments, the elevator 1320 lowering the tubular may transfer at least some of the weight of the tubular 1325 from the elevator 1320 to the floor of the rig via an already installed tubular. In some embodiments, the lifting mechanism may align the at least two spring bail cylinders 10 around the CRT 1330 and align the tubular 1325 centered below the member 1335 of the CRT 1330.

As also shown in FIG. 17, process 1700 may include lowering the CRT 1330 and the two spring bail cylinders 10 while simultaneously converting the two spring bail cylinders 10 to the retracted configuration to maintain alignment of the member 1335 of the CRT 1330 with the top of the tubular 1325 (block 1708). For example, the processor may instruct the lifting mechanism to lower the CRT 1330 while simultaneously converting the two spring bail cylinders 10 to the retracted configuration to maintain alignment of the member 1335 of the CRT 1330 with the top of the tubular 1325, as described above.

In some embodiments, the transfer of the weight from the elevator 1320 to the floor of the rig also transfers the weight away from the spring bail cylinder 10 while maintaining tension and alignment between the member 1335 of the CRT 1330 and the coupling of the tubular 1325 as the CRT 1330 and the spring bail cylinder 10 are lowered. In some embodiments, the CRT 1330 is lowered and may allow the member 1335 of the CRT 1330 to enter the tubular 1325 while simultaneously shifting the remaining weight held by the elevator 1320 to the ground floor via a n already installed tubular. In some embodiments, while the remaining weight held by the elevator 1320 is transferred to the rig floor, the spring bail cylinder 10 shifts to a retracted configuration simultaneous with the CRT 1330 and the spring bail cylinder 10 being lowered. In some embodiments, the lowering of the CRT 1330 and the spring bail cylinder 10 shifts the remaining weight from the elevator 1320 to the rig floor and simultaneously causes the spring bail cylinder 10 to contract to a retracted configuration. In some embodiments, the contracting of the spring bail cylinder 10 to a retracted configuration utilizes tension from the spring bail cylinder 10 to maintain alignment of the member 1335 of the CRT 1330 to the tubular 1325 as the CRT 1330 lowers the member 1335 into the tubular 1325.

Although FIG. 17 shows example blocks of process 1700, in some implementations, process 1700 may include additional blocks, fewer blocks, different blocks, or differently arranged blocks than those depicted in FIG. 17. Additionally, or alternatively, two or more of the blocks of process 1700 may be performed in parallel.

Figure 18A:
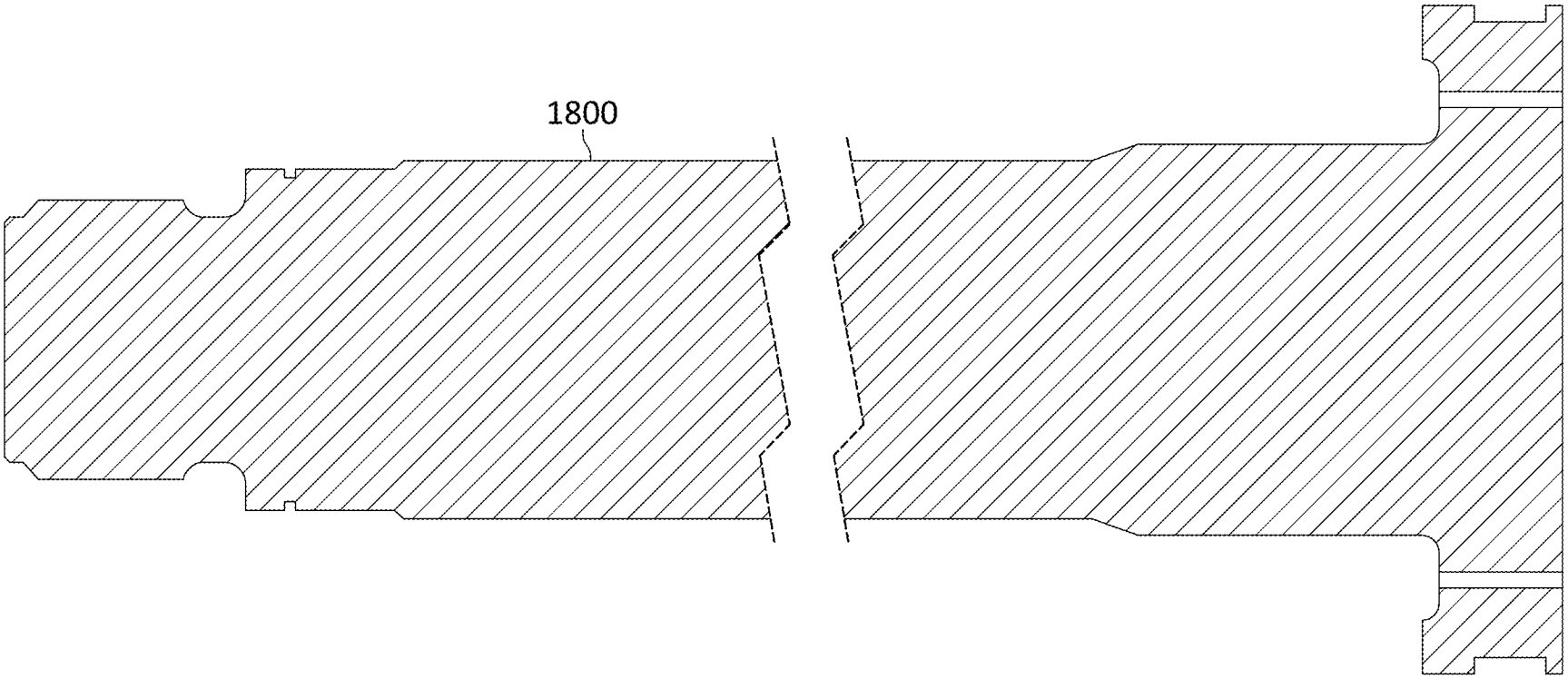
FIGS. 18A-18C provide a cross-sectional view, top view, and perspective view, respectively, of a plunger of a third embodiment of the spring bail cylinder apparatus, as described herein.
Figure 18B:
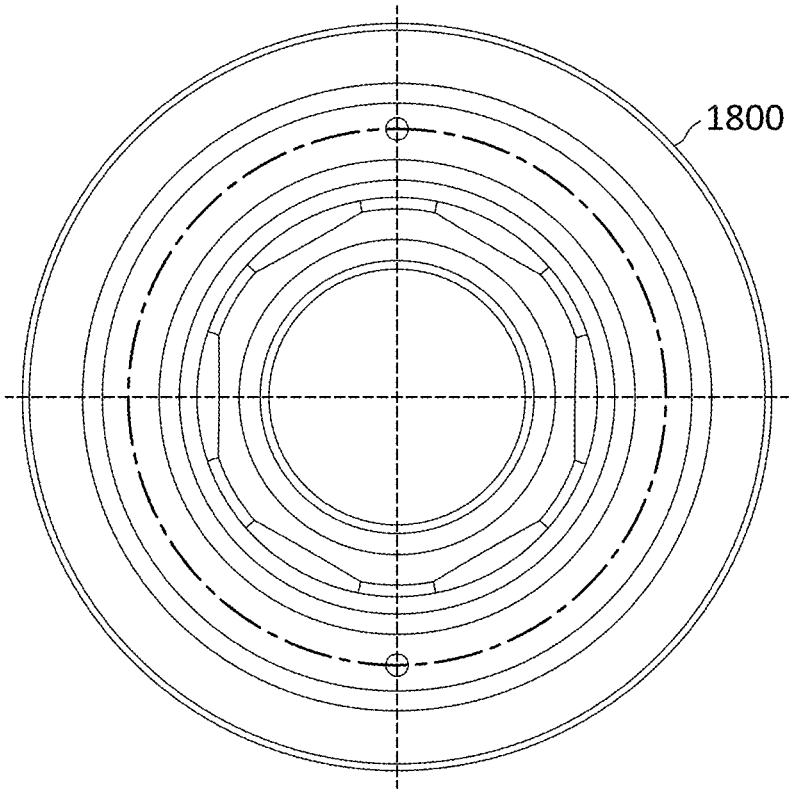
Figure 18C:
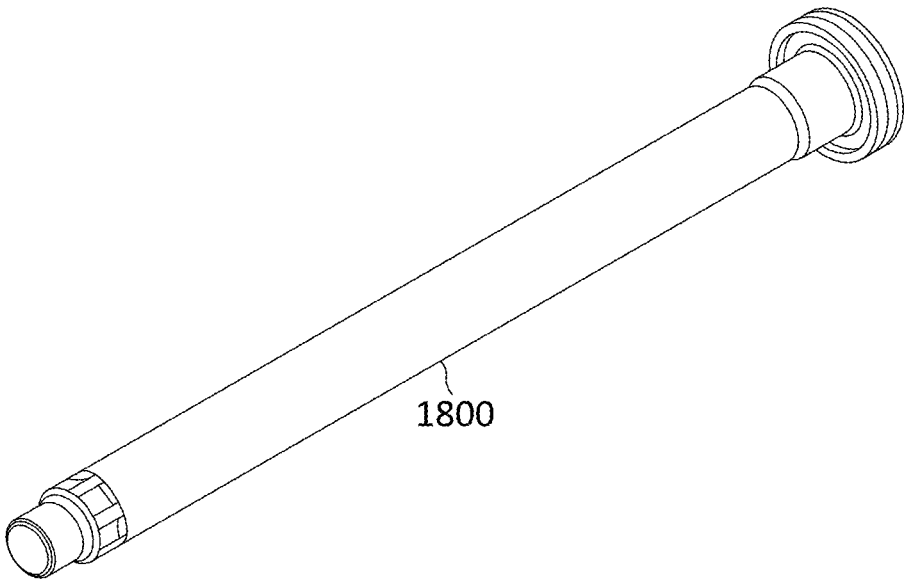
Figure 19:
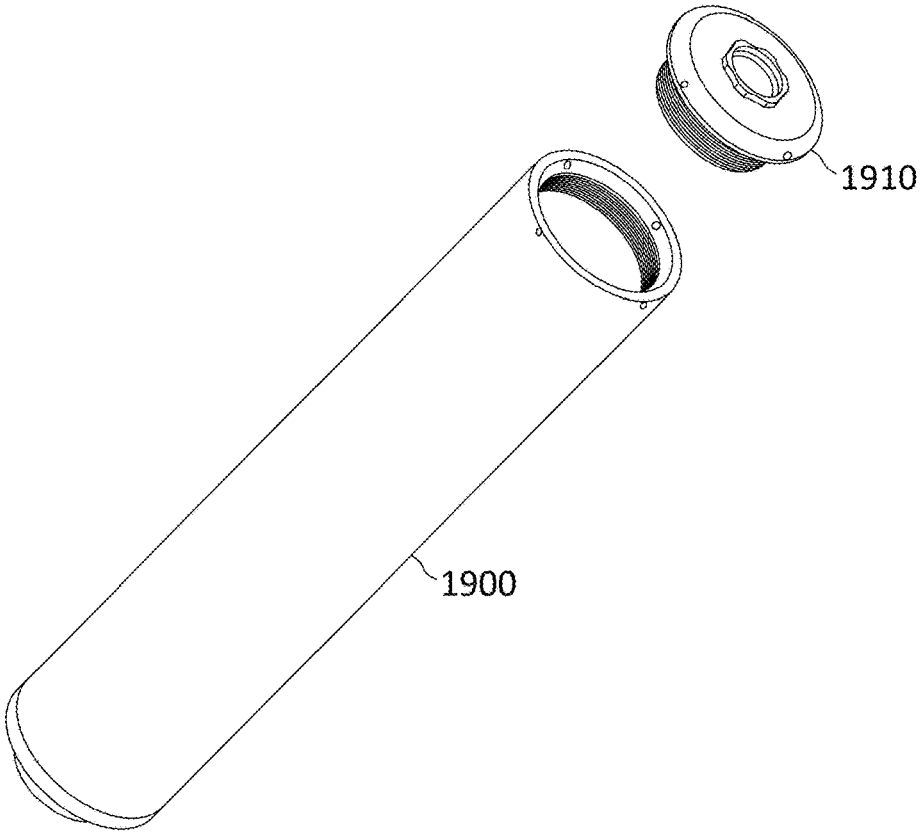
FIGS. 19-21 provide an exploded perspective view of the components of the third embodiment of the spring bail cylinder apparatus as described herein.
Figure 20:
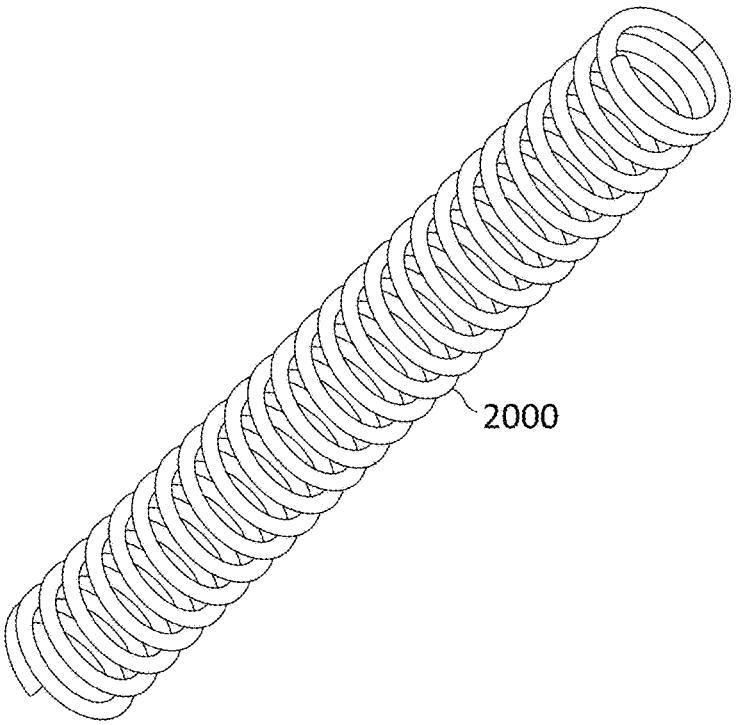
Figure 21:
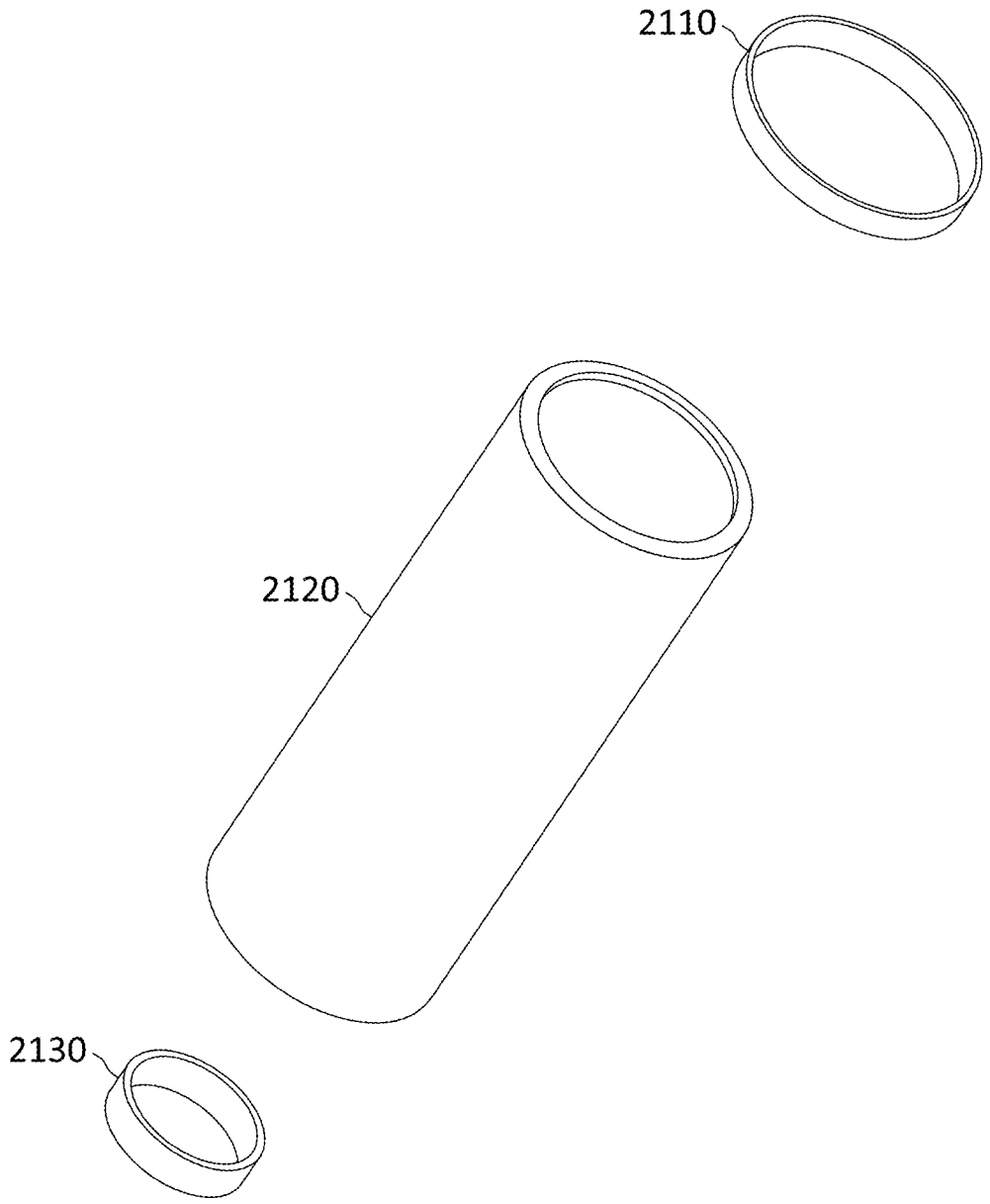
Figure 22:
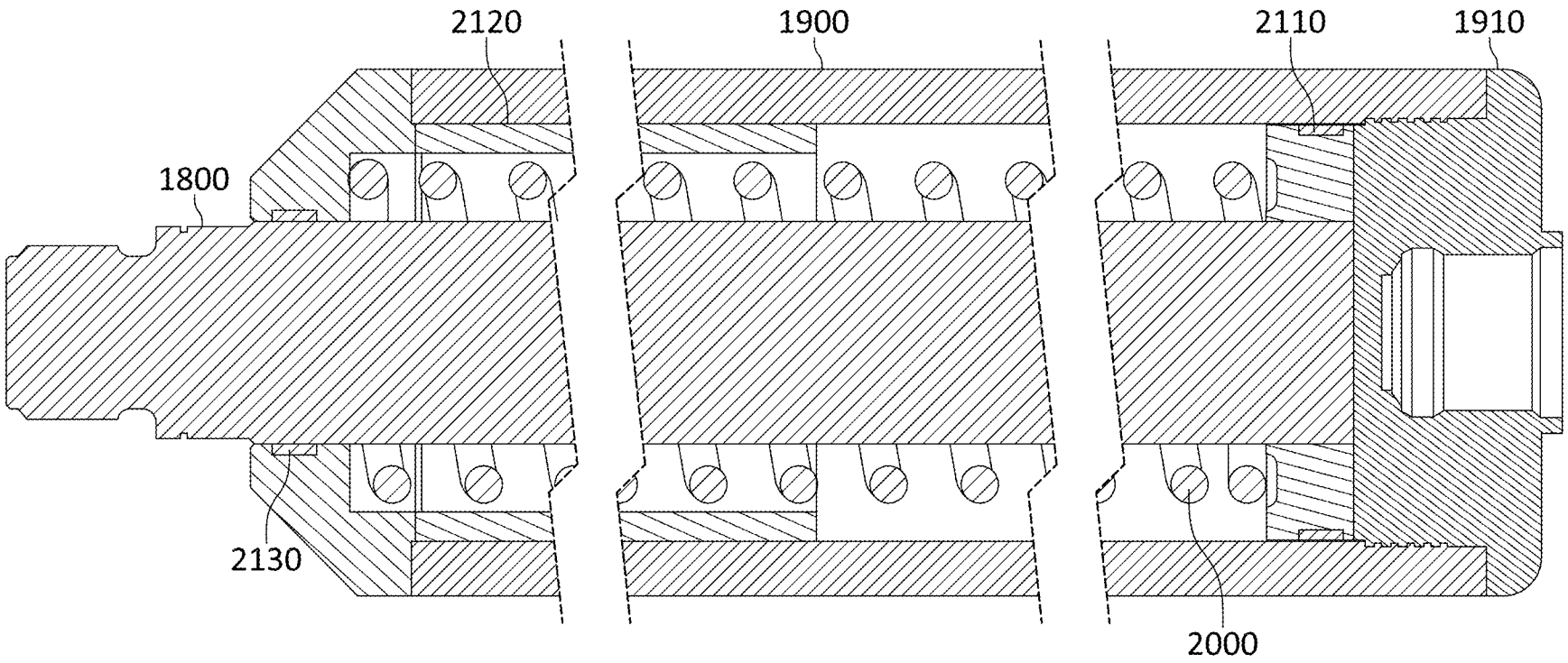
FIG. 22 provides a cross-sectional view of the third embodiment of the spring bail cylinder apparatus as described herein.

Now referring to FIGS. 18A-18C illustrates a plunger 1800 of the third embodiment of the spring bail cylinder where the body of the plunger 1800 may comprise a single component. In some embodiments, the plunger 1800 may be milled from a single piece of material to avoid welding the top component of the plunger 1800. The milled construction of the plunger 1800 leads to greater resistant to wear and avoids the weak point created by welding two pieces of material together.

Referring to FIGS. 19-22, illustrates the third non-limiting embodiment of the invention, the spring bail cylinder which may comprise a stop cylinder 2120, a spring 2000, a plunger 1800, a cylinder 1900, a first wear band 2130, a second wear band 2110, and a cap 1910. The third nonlimiting embodiment of the spring bail cylinder may operate in the same manner as the first embodiment. The third embodiment may adapt to the bottom section of the bail (e.g., a VARILINK bail). In some embodiments, the third embodiment of the spring bail cylinder may operate for a greater number of cycles than the first embodiment.

In some embodiments, the third embodiment of the spring bail cylinder may be comprised of 4130 tool steel, apart from the outer cylinder, which may be comprised of 1029 steel. The 4130 tool steel was chosen for its excellent tensile strength at smaller diameters, a necessity due to the large potential loads, and diameter limitations of its use application. The outer cylinder may be comprised of 1026 steel, as 4130 steel for that diameter and length would have been too costly to machine on a short timeline. In some embodiments, components made from aluminum, carbon, titanium, plastic, or some composite thereof.

In some embodiments, the third embodiment of the spring bail cylinder was designed as an improvement over a hydraulic cylinder due to its excellent wear resistance at high cycle rates. To assist in wear resistance, the first wear band 2130, the second wear band 2110 may comprise nylon, plastic, TEPHLON, peek, polyamide, torlon, phenolic or any material resistant to wear. In some embodiments, the first wear band 2130, the second wear band 2110 may be used where metal would otherwise slide against metal, greatly reducing friction and wear. In some embodiments, the first wear band 2130 may be located about the inside of the small hole in the gland to reduce wear on the rod as it moves through, respectively. In some embodiments, the second wear band 2110 may be located along the outside of the rod's wide end to reduce friction on the cylinder.

In some embodiments, the internal walls of the cylinder 1900 will also be lubricated to reduce friction and prevent corrosion from ambient moisture. As the cylinder 1900 is not a hydraulic cylinder, small holes have been drilled through the wide disc of the plunger 1800 and the threaded gland of the plunger 1800 to allow the pressure in the two halves to equalize. This has the added benefit of providing a slight cushion the plunger 1800 extends and retracts. The pressures equalize slowly, creating a negative pressure that resists the movement of the plunger 1800 until they equalize. Further development may include the use of pressurized air in this chamber.

In some embodiments, the outermost hole may be drilled into the plunger 1800 as it faces downward, which may prevent rain and snow from seeping into the cylinder and may also act as a drain in case condensation begins to build up inside.

In some embodiments, the third embodiment of the spring bail cylinder may be configured for use on a drilling rig floor, and the hydraulics are saturated in sub-zero climates to allow the extension and alignment of the rig's elevator with its top drive and subsequent retraction once the tubular is stabbed into the stump and top drive is lowered to connect with box end of the new joint.

In some embodiments, the third embodiment of the spring bail cylinder may be operated without outside intervention and is resistant to high cycle rates, corrosion, and cold while operating.

CLAUSES

Example Clause A: A method for a spring bail cylinder assisted alignment of a tubular with a casing running tool, the method may include: securing, via an elevator, the tubular from a position below the casing running tool where the elevator is connected to a lifting mechanism by two or more spring bail cylinders in a retracted configuration; lifting the tubular via the elevator and converting the two or more spring bail cylinders to an extended configuration by the weight of the tubular; aligning the tubular with a member of the casing running tool at a top of the tubular, aligning the two or more spring bail cylinders around the casing running tool, and lowering the tubular to shift the weight of the tubular to a bottom of the tubular; and lowering the casing running tool and the two or more spring bail cylinders while simultaneously converting the two or more spring bail cylinders to the retracted configuration to maintain alignment of the member of the casing running tool with the top of the tubular.

Example Clause B: The method of Example Clause A, further may include: detaching the elevator from the tubular and moving the two or more spring bail cylinders and the elevator away from the casing running tool; and installing, via the casing running tool, the tubular to a second tubular already installed on a floor of a rig.

Example Clause C: The method of Example Clause A or Example Clause B, where a spring bail cylinder may include: a cylinder and a plunger, where forces acting in opposite directions on the spring bail cylinder, that are greater than a threshold, cause the spring bail cylinder to convert from the retracted configuration to the extended configuration.

Example Clause D: The method of any one of Example Clauses A-C, where the plunger further may include: a rod with a disk located at a first end and a short-threaded section at a second end, where the disc may include holes which allow an internal pressure of the cylinder to equalize.

Example Clause E: The method of any one of Example Clauses A-D, where the spring bail cylinder further may include a compression spring in a top hanger style.

Example Clause F: The method of any one of Example Clauses A-E, where the spring bail cylinder further may include a stop cylinder, which limits an extension of the spring bail cylinder and transfers a load from the plunger to the cylinder.

Example Clause G: A device for a spring bail cylinder assisted alignment of a tubular with a casing running tool may include: one or more processors configured to: secure, via an elevator, the tubular from a position below the casing running tool where the elevator is connected to a lifting mechanism by two or more spring bail cylinders in a retracted configuration; lift the tubular via the elevator and convert the two or more spring bail cylinders to an extended configuration by the weight of the tubular; align the tubular with a member of the casing running tool at a top of the tubular, align the two or more spring bail cylinders around the casing running tool, and lower the tubular to shift the weight of the tubular to a bottom of the tubular; and lower the casing running tool and the two or more spring bail cylinders while simultaneously convert the two or more spring bail cylinders to the retracted configuration to maintain alignment of the member of the casing running tool with the top of the tubular.

Example Clause H: The device of Example Clause G, where the one or more processors are further configured to: detach the elevator from the tubular and move the two or more spring bail cylinders and the elevator away from the casing running tool; and install, via the casing running tool, the tubular to a second tubular already installed on a floor of a rig.

Example Clause I: The device of Example Clause G or Example Clause H, where a spring bail cylinder may include a cylinder and a plunger, where forces act in opposite directions on the spring bail cylinder, that are greater than a threshold, cause the spring bail cylinder to convert from the retracted configuration to the extended configuration.

Example Clause J: The device of any one of Example Clauses G-I, where the plunger further may include a rod with a disk located at a first end and a short-threaded section at a second end, where the disc may include holes which allow an internal pressure of the cylinder to equalize.

Example Clause K: The device of any one of Example Clauses G-J, where the spring bail cylinder further may include a compression spring in a top hanger style.

Example Clause L: The device of any one of Example Clauses G-K, where the spring bail cylinder further may include a stop cylinder which limits an extension of the spring bail cylinder and transfers a load from the plunger to the cylinder.

Example Clause M: A system for a spring bail cylinder assisted alignment of a tubular with a casing running tool may include: one or more processors configured to: secure, via an elevator, the tubular from a position below the casing running tool where the elevator is connected to a lifting mechanism by two or more spring bail cylinders in a retracted configuration; lift the tubular via the elevator and convert the two or more spring bail cylinders to an extended configuration by the weight of the tubular; align the tubular with a member of the casing running tool at a top of the tubular, align the two or more spring bail cylinders around the casing running tool, and lower the tubular to shift the weight of the tubular to a bottom of the tubular; and lower the casing running tool and the two or more spring bail cylinders while simultaneously converting the two or more spring bail cylinders to the retracted configuration to maintain alignment of the member of the casing running tool with the top of the tubular.

Example Clause N: The system of Example Clause M, where the one or more processors are further configured to: detach the elevator from the tubular and move the two or more spring bail cylinders and the elevator away from the casing running tool; and install, via the casing running tool, the tubular to a second tubular already installed on a floor of a rig.

Example Clause O: The system of Example Clause M or Example Clause N, where a spring bail cylinder may include a cylinder and a plunger, where forces act in opposite directions on the spring bail cylinder, that are greater than a threshold, cause the spring bail cylinder to convert from the retracted configuration to the extended configuration.

Example Clause P: The system of any one of Example Clauses M-O, where the plunger further may include a rod with a disk located at a first end and a short-threaded section at a second end, where the disc may include holes which allow an internal pressure of the cylinder to equalize.

Example Clause Q: The system of any one of Example Clauses M-P, where the spring bail cylinder further may include a compression spring in a top hanger style.

Example Clause R: The system of any one of Example Clauses M-Q, where the spring bail cylinder further may include a stop cylinder which limits an extension of the spring bail cylinder and transfers a load from the plunger to the cylinder.

Example Clause S: A spring bail cylinder apparatus, may include: a cylinder containing a plunger, a spring, and a stop cylinder sealed on a first end by a gland and a second end with a plug, where the plunger partially extends out from the cylinder; the plug having an internal recess which the spring rests in and keeps the spring centered; the stop cylinder having an outer diameter less than an inner diameter of the cylinder and which limits the movements of the spring and transfers a load of the plunger directly to the cylinder when the spring bail cylinder is in a fully extended configuration; and the plunger having an end which does not extend from the cylinder having a disk which separates an interior of the cylinder into two sections and where the disk has one or more holes which equalize pressure between the two sections.

Example Clause T: The spring bail cylinder apparatus of Example Clause S, where the spring is a top hanger style spring.

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A method for a spring bail cylinder assisted alignment of a tubular with a casing running tool, the method comprising:

securing, via an elevator, the tubular from a position below the casing running tool where the elevator is connected to a lifting mechanism by two or more spring bail cylinders in a retracted configuration;

lifting the tubular via the elevator and converting the two or more spring bail cylinders to an extended configuration by the weight of the tubular;

aligning the tubular with a member of the casing running tool at a top of the tubular, aligning the two or more spring bail cylinders around the casing running tool, and lowering the tubular to shift the weight of the tubular to a bottom of the tubular; and lowering the casing running tool and the two or more spring bail cylinders while simultaneously converting the two or more spring bail cylinders to the retracted configuration to maintain alignment of the member of the casing running tool with the top of the tubular.

2. The method of claim 1, further comprising:

detaching the elevator from the tubular and moving the two or more spring bail cylinders and the elevator away from the casing running tool; and installing, via the casing running tool, the tubular to a second tubular already installed on a floor of a rig.

3. The method of claim 1, wherein a spring bail cylinder comprises:

a cylinder and a plunger, where forces acting in opposite directions on the spring bail cylinder, that are greater than a threshold, cause the spring bail cylinder to convert from the retracted configuration to the extended configuration.

4. The method of claim 3, wherein the plunger further comprises:

a rod with a disk located at a first end and a short-threaded section at a second end, where the disc comprises holes which allow an internal pressure of the cylinder to equalize.

5. The method of claim 3, wherein the spring bail cylinder further comprises a compression spring in a top hanger style.

6. The method of claim 3, wherein the spring bail cylinder further comprises a stop cylinder, which limits an extension of the spring bail cylinder and transfers a load from the plunger to the cylinder.

7. A spring bail cylinder device adapted for assisted alignment of a tubular with a casing running tool, the device comprising:

an apparatus configured to:

secure, via an elevator, a tubular from a position below a casing running tool where the elevator is connected to a lifting mechanism by two or more spring bail cylinders in a retracted configuration;

lift the tubular via the elevator and convert the two or more spring bail cylinders to an extended configuration by the weight of the tubular;

align the tubular with a member of the casing running tool at a top of the tubular, align the two or more spring bail cylinders around the casing running tool, and lower the tubular to shift the weight of the tubular to a bottom of the tubular; and lower the casing running tool and the two or more spring bail cylinders while simultaneously convert the two or more spring bail cylinders to the retracted configuration to maintain alignment of the member of the casing running tool with the top of the tubular.

8. The device of claim 7, wherein the apparatus is further configured to:

detach the elevator from the tubular and move the two or more spring bail cylinders and the elevator away from the casing running tool; and install, via the casing running tool, the tubular to a second tubular already installed on a floor of a rig.

9. The device of claim 7, wherein the spring bail cylinder comprises a cylinder and a plunger, where forces act in opposite directions on the spring bail cylinder, that are greater than a threshold, cause the spring bail cylinder to convert from the retracted configuration to the extended configuration.

10. The device of claim 9, wherein the plunger further comprises a rod with a disk located at a first end and a short-threaded section at a second end, where the disc comprises holes which allow an internal pressure of the cylinder to equalize.

11. The device of claim 9, wherein the spring bail cylinder further comprises a compression spring in a top hanger style.

12. The device of claim 9, wherein the spring bail cylinder further comprises a stop cylinder which limits an extension of the spring bail cylinder and transfers a load from the plunger to the cylinder.

13. A system for a spring bail cylinder assisted alignment of a tubular with a casing running tool comprising:

with operation by at least one of a processor and a human operator, the system configured to:

secure, via an elevator, the tubular from a position below the casing running tool where the elevator is connected to a lifting mechanism by two or more spring bail cylinders in a retracted configuration;

lift the tubular via the elevator and convert the two or more spring bail cylinders to an extended configuration by the weight of the tubular;

align the tubular with a member of the casing running tool at a top of the tubular, align the two or more spring bail cylinders around the casing running tool, and lower the tubular to shift the weight of the tubular to a bottom of the tubular; and lower the casing running tool and the two or more spring bail cylinders while simultaneously converting the two or more spring bail cylinders to the retracted configuration to maintain alignment of the member of the casing running tool with the top of the tubular.

14. The system of claim 13, wherein the system is further configured to:

detach the elevator from the tubular and move the two or more spring bail cylinders and the elevator away from the casing running tool; and install, via the casing running tool, the tubular to a second tubular already installed on a floor of a rig.

15. The system of claim 13, wherein the spring bail cylinder comprises a cylinder and a plunger, where forces act in opposite directions on the spring bail cylinder, that are greater than a threshold, cause the spring bail cylinder to convert from the retracted configuration to the extended configuration.

16. The system of claim 15, wherein the plunger further comprises a rod with a disk located at a first end and a short-threaded section at a second end, where the disc comprises holes which allow an internal pressure of the cylinder to equalize.

17. The system of claim 15, wherein the spring bail cylinder further comprises a compression spring in a top hanger style.

18. The system of claim 15, wherein the spring bail cylinder further comprises a stop cylinder which limits an extension of the spring bail cylinder and transfers a load from the plunger to the cylinder.

* * * * *